United States Patent [19]

Perry

[11] Patent Number: 4,577,561

[45] Date of Patent: Mar. 25, 1986

[54] DIGITAL TIME FUZE METHOD AND APPARATUS

[75] Inventor: John W. Perry, Little Rock, Ark.

[73] Assignee: BEI Electronics, Inc., Euless, Tex.

[21] Appl. No.: 369,749

[22] Filed: Apr. 19, 1982

[51] Int. Cl.[4] ..... F42C 11/06

[52] U.S. Cl. ..... 102/215

[58] Field of Search ..... 102/215

[56] References Cited

U.S. PATENT DOCUMENTS

| | | | |
|---|---|---|---|
| 3,500,746 | 3/1970 | Ambrosini | 102/215 |
| 3,622,987 | 11/1971 | Borkan | 102/215 |
| 3,646,371 | 2/1972 | Flad | 102/215 |
| 3,657,571 | 4/1972 | Martin et al. | 102/215 |
| 4,083,308 | 4/1978 | Levis | 102/215 |
| 4,324,182 | 4/1982 | Kirby et al. | 102/215 |
| 4,424,745 | 1/1984 | Magorian et al. | 102/215 |

*Primary Examiner*—Charles T. Jordan

*Attorney, Agent, or Firm*—Limbach, Limbach & Sutton

[57] ABSTRACT

A digital time fuze for providing an output pulse following a precise, specified time interval, wherein control means extract time interval data from a set signal, the control means thereafter providing a portion of a clock signal to a counter such that the length of the portion of the clock signal provided is determined by the time interval data. Counter means count the number of pulses in the clock signal portion to accumulate a timer count. In response to a start signal, the counter means counts down the timer count according to a count down clock which is provided by the control means and which is proportional to and derived from the clock signal. When the count reaches zero the output pulse is provided.

26 Claims, 5 Drawing Figures

DIGITAL TIME FUZE METHOD AND APPARATUS

BACKGROUND OF THE INVENTION

The present invention relates generally to digital timing circuits and, more particularly, to a digital time fuze. In the past, it was usual for electronic time fuzes to employ an RC timing circuit. These were normally energized from the battery which required considerable space, weight, and cost, and had a finite shelf life as well. Further, the RC components had to be precise and were required to maintain the values unchanged for considerable cperiods of time. Additionally, elaborate temperature compensation was necessary in order to produce accurate results. Such RC timing circuit requirements presented serious problems in the design of electronic time fuzes of the past.

More recently, an analog time fuze was proposed in U.S. Pat. No. 3,502,024 to Mountjoy. The time fuze of the Mountjoy patent is a battery-less fuze which has a large capacitor to supply the energy for both the timing circuit and the operation of the detonator at the conclusion of the timing cycle. This fuze employs a timing circuit which is relatively insensitive to the capacitance of the large capacitor and permits compensation for variations from standard values of the capacitive and resistive components used within the timing circuit. Such compensation takes the form of voltages supplied just prior to launching of the missile or projectile.

The Mountjoy patent further discloses a means for charging the energy supply capacitor in the fuze, as well as supplying information on the desired run time of the fuze, through use of a single wire connection and voltages of opposite polarities. By run time, it is meant the time period between launching of the missile or projectile and the firing of the detonator.

Despite the advances represented by the Mountjoy patent disclosure, the time fuze disclosed therein has an inherent run time accuracy determined by the precision of certain of its components. This timing accuracy generally decreases with increasing run time of the fuze. Additionally, for longer run times it is conceivable that larger values of the RC timing components would be required in order to obtain acceptable accuracy for the period.

Moreover, the accuracy of the analog fuze is obtained by way of either explicit knowledge of component values of the resistive and capacitive elements in the fuze or by some measurement or compensation scheme of the time-setting mechanism circuitry. Such compensation techniques require precise measurement and complex setting circuitry to calculate and set the run time of the fuze. Even so, other effects such as temperature drifts cannot be easily compensated for.

Another major contributor toward analog fuze inaccuracy, which cannot easily be compensated for, is a capacitor defect known as dielectric absorption. This effect is very pronounced for longer fuze run times with high value capacitors. Dielectric absorption effects are not obvious from a direct capacitance measurement. It cannot be easily compensated for by the conventional setters. By setter, it is meant external equipment which supplies run time information to the fuze, such run time information being calculated within the setter according to known parameters of the time fuze and externally dictated time of flight requirements.

Another disadvantage of the Mountjoy fuze involves the bipolar nature of the charging signature, i.e., the signal by which the energy for running the circuit is supplied to the energy storage capacitor, as well as the run time information supplied to the timing circuit itself. This bipolar signal precludes easy signal multiplexing which would allow both fuze charging and setting, and rocket firing from the same signal wire.

SUMMARY OF THE INVENTION

These and other problems of prior art time fuzes are overcome by the present invention of a digital time fuze which provides an output signal at a selected and precise time interval following the occurrence of a start signal and in accordance with time interval data which is contained within a set signal. The apparatus comprises oscillator means, control means and counter means. The oscillator means provide a clock signal having a clock frequency which comprises a series of clock pulses. The control means are responsive to the set signal, and the clock signal to provide an accumulate signal which includes an interval of the clock signal, the length of the interval being determined in accordance with the set signal time interval data. The control means also provide a count down signal which is initiated by the start signal and which has a frequency rate which is proportional to the clock signal frequency.

The counter means are responsive to the count down signal and to the accumulate signal, wherein the counter means count the number of clock pulses provided in the accumulate signal in order to form a timer count. In response to the count down signal, the counter means counts down from the timer count at a rate determined by the frequency of the count down signal. When the count of the counter means reaches zero, the output pulse is provided.

The above apparatus implements the method of providing a digital timing fuze which includes the steps of generating a clock frequency which comprises a series of clock pulses; counting the clock pulses present in the clock signal over an interval, determined by time interval data within the set signal, to form a timer count; counting down from the timer count at a rate which is proportional to and derived from the clock frequency, and providing an output pulse when the counter count reaches zero.

The above digital time fuze uses low power, low cost digital logic circuit elements. No battery is required. All time fuze power is supplied by a charged capacitor. Precision run times are achieved with a single-wire connection to the fuze using a single polarity signal for both fuse charging and time setting. Thus, the same wire may also be used to control missile or projectile firing or to provide selection of variable modes of operation using the opposite polarity. In addition, the precentage time inaccuracy of the digital time fuze generally decreases with increasing fuze run time making the digital time fuze of the present invention particularly suitable for longrange, accurate firing missions.

It is, therefore, an object of the present invention to provide a digital time fuze which has very high percentage time accuracy, even over long-run times.

It is another object of the present invention to provide a digital time fuze which can be charged and set over a single wire.

It is still another object of the present invention to provide a digital time fuze which can be charged and set by a single wire, and which is compatible with a multiplex system using a single wire for fuze set and rocket motor ignition.

It is a further object of the present invention to provide a digital time fuze requiring only components of nominal tolerances.

It is still a further object of the present invention to provide a digital time fuze which can be charged and set using a single polarity of voltage.

It is another object of the present invention to provide a digital time fuze where precision voltage levels are not required for precision run time operation.

It is another object of the present invention to provide a digital time fuze wherein an interval of a clock signal having an arbitrary frequency is utilized to establish a timer count within a counter means, and further-wherein a signal proportional to and derived from the clock signal is used to count the counter means down from the timer count, wherein the time interval required to count down the timer count is the precise time interval provided.

It is a still further object of the present invention to provide a digital time fuze wherein time interval information comprising a time period is transformed into a binary count, which is then counted down, and further-wherein the quantity of the binary count need not be directly translatable to the time interval desired to be established.

It is another object of the present invention to provide a digital time fuse wherein a precision absolute frequency reference is not required.

It is a still further object of the present invention to provide a digital time fuze wherein there are no critical timing requirements in the presentation of the time interval data within the charging/setting signature.

It is a still further object of the present invention to provide a digital time fuze, the accuracy of which increases as the run time increases.

It is still another object of the present invention to provide a digital time fuze which is compatible with existing analog fuze setters.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE INVENTION

Figure 1:
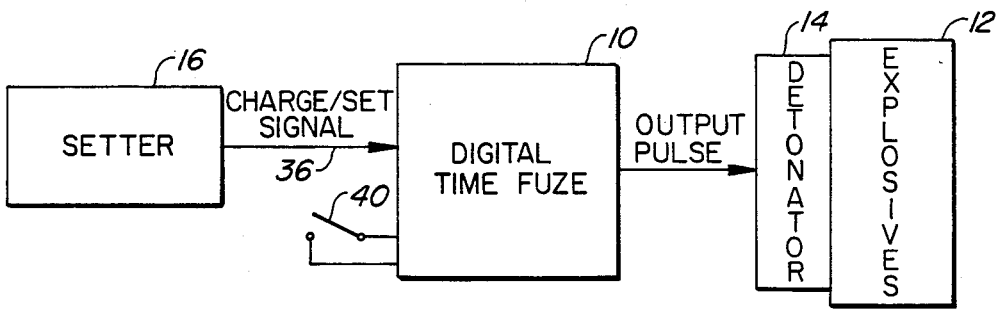
FIG. 1 is a block diagram of the present invention as utilized in an ordinance system.
Figure 3:
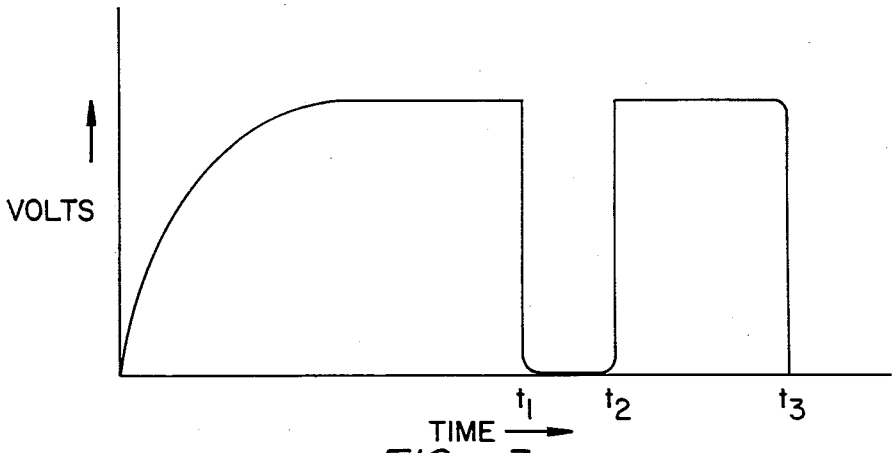
FIG. 3 is a graph of the charge/set signature utilized in initializing the digital time fuze of the present invention.
Figure 5:
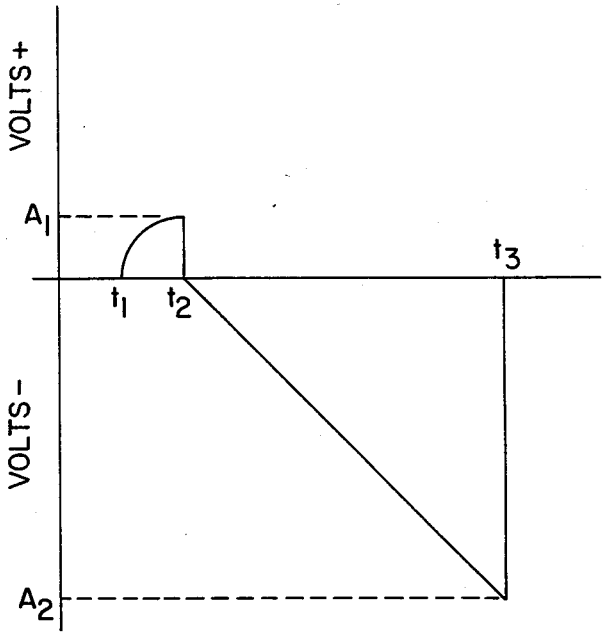
FIG. 5 is a graph of the charge/set signature used to initialize the alternative embodiment of the present invention.

Referring to FIG. 1, the function of the digital time fuse within an ordinance system will now be described. The digital time fuse provides an output pulse at a predetermined time period following the launching of a projectile or rocket. This output pulse is supplied to the explosives package 12 and, more specifically, to a detonator 14 within the explosives package. The digital time fuze is supplied with power and run time information from setter 16. Typically, setter 16 contains circuitry which takes into account the various conditions in existence at the time of launch, receives range and other information from the user, and based upon such information calculates the time period required in order to detonate the explosives at the required distance and the required altitude. The signal provided by the setter also contains the waveform by which electrical power is transferred to the fuze circuitry. The combination of timing information and power waveforms in a single signal results in a waveform having a particular "signature". The signature of the setter waveforms for certain embodiments of the present invention are illustrated in FIGS. 3 and 5. Hereinafter, the signal supplied by the setter may be referred to in one of several ways including, charge/set signal and setter signal, it being understood that the same signal is being referred to. Switch 40 provides a signal to the digital time fuze 10 which is indicative of the actual launch of the rocket or projectile, and which directs the digital time fuze to begin the timing period. This switch 40 can be an inertial switch which is part of the digital time fuze circuitry.

Figure 2:
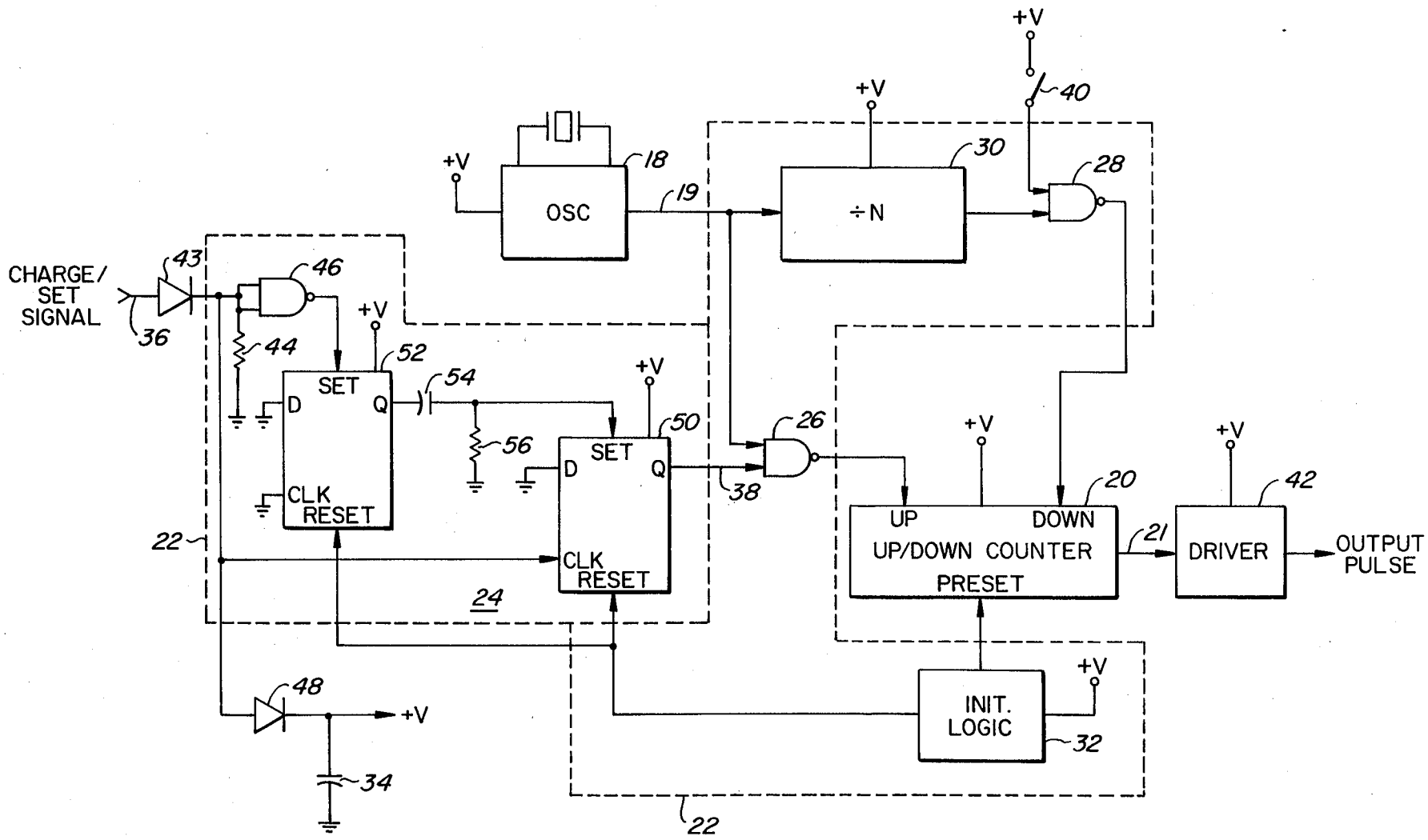
FIG. 2 is a simplified schematic diagram of the present invention.

Referring to FIG. 2, the circuitry of the digital time fuse will be described in greater detail. Generally, the function of the digital time fuze can be divided into three distinct functional areas: an oscillator section 18, a counter section 20, and a control circuit section 22. The oscillator 18 can be crystal controlled with a frequency on the order of several thousand kilohertz. Alternatively, the oscillator 18 can be any one of a number of conventional oscillators, including a piezoceramic oscillator which utilizes a piezoceramic element, such as the CSA/CSB series, for example CSB200, of Murata Corporation located in Marietta, Ga. It is not a requirement that the oscillator have a precise absolute frequency, nor are any precision components required for the oscillator. The oscillator supplies a clock signal on line 19 to the control circuit 22. In a preferred embodiment to the present invention, the oscillator frequency is 200 kilohertz.

The counter circuitry 20 can be any binary counter which is capable of counting the number of pulses present in a pulse stream so as to accumulate a timer count, as well as the ability to count down from the timer count according to a supplied frequency rate.

The control circuit 22 includes the decoding circuitry 24 for extracting run time information from the charge signal, gating circuits 26 and 28 for supplying count up and count down signals to the counter circuit 20, divide-by-N circuit 30 for providing a count-down signal which is proportional to the oscillator frequency, and initialization logic 32 for initializing the decoder 24 and counter circuit 20.

Generally, the charge/set signal is supplied to the decoder circuit 24 on line 36. The signal appears in FIG. 3. Capacitor 34 is the energy storage capacitor which is charged by the charge signal and which, during the fuze run time, supplies power to all components within the digital time fuze.

The positive portions of the charge/set signal comprise the power-up interval and are utilized to charge energy storage capacitor 34, while the zero voltage portion ($t_1$ to $t_2$) carries the run time information.

Decoder circuitry 24 acts to extract the run time information and supplies a count-up pulse to gate 26 via line 38. This count-up pulse has substantially the same duration as the interval of zero voltage within the charge signal. The other input to gate 26 is supplied from oscillator 18 via line 19. Therefore, when the count-up pulse is present on line 38, the signal from oscillator 18 is passed through gate 26 to form the accumulate signal, which is then applied to the count-up input of counter circuit 20. The counter circuit 20 then counts the number of pulses present in the accumulate signal in order to establish a binary timer count.

The function of initialization logic 32 is to prepare the decoder circuit 24 and counter circuit 20 for the reception of run time information and the accumulate signal respectively. At some non-critical time after the initial application of the charge/set signal to line 36, and in response to a positive voltage on the +V line, initialization logic 32 supplies a preset pulse to counter circuit 20 and a clear pulse to decoder circuit 24. At some arbitrary time thereafter, the run time information appears in the charge/set signal. This information is then processed by decoder circuit 24 to derive the count-up pulse and generate the accumulate signal by which the binary timer count is established in counter circuit 20.

In the absence of the count-up pulse on line 38, there are no pulses present in the output from gate 26 and no further increase in the timer count occurs. In this manner, a binary timer count is established within counter circuit 20 which reflects the number of pulses present within a time interval, wherein the time interval is determined by the run time information contained within the charge/set signature. The digital time fuze is thus initialized with run time information.

Upon launch of the rocket or projectile, switch 40 closes. Switch 40 can be an inertial switch, for example, which closes when the projectile is set in motion. This supplies a logic 1 voltage level to one of the inputs of gate 28. The other input to gate 28 is supplied by a scaling counter or divide-by-N circuit 30. The input to divide-by-N circuit 30 is provided on line 19 by oscillator 18. Thus, the output of divide-by-N circuit 30 is at some frequency proportional to and derived from the oscillator frequency. For example, if N equals 1, then the output of divide-by-N circuit 30 would be the oscillator frequency; conversely, if N equals 1000, the signal output from divide-by-N circuit 30 would have a frequency one one-thousanth of the oscillator frequency. When switch 40 is closed, gate 28 passes the output of divide-by-N circuit 30 to the count-down input of counter circuit 20. Thus, the timer count contained within counter circuit 20 is counted down at a rate determined by the divide-by-N circuit 30 and proportional to oscillator frequency. In this manner, the same signal or a signal directly proportional thereto is used to count down the timer count as was used to establish the timer count. In this manner, any inaccuracies of the oscillator circuit are cancelled out.

The use of the oscillator signal in this manner is functionally analogous to the use of carrier signal in communication systems. In such systems, the carrier signal merely serves as a means by which desired information is transmitted between two points, the carrier signal being removed when the signal is processed at the receiving end. Similarly, the use of a signal directly proportional to and derived from the oscillator frequency in counting down from the timer count in counter circuitry 20 effectively cancels out the effects of the oscillator signal in counting up or establishing the timer count.

When the count within counter circuitry 20 reaches zero, a pulse is supplied to driver 42 which then provides an output pulse which has sufficient energy content to initiate the detonator 14 in the explosives section 12. In the preferred embodiment, the counter pulse is generated when the last bit in the timer count is counted out and a borrow pulse propagates through the counter circuitry 20 to output line 21. In the preferred embodiment, driver 42 is a re9enerative switch. Use of a regenerative switch permits the generation of an output pulse which has a sufficient pulsewidth to supply an adequate amount of energy to the detonator 14 to ensure detonation.

Referring to the circuitry within the decoder circuit 24, the manner in which the run time information is extracted from the charge/set signature will now be explained. The signal supplied by the setter 16 on line 36 is supplied to the decode circuitry 24 via diode 43.

The anode of diode 43 is connected to one end of resistor 44, to both inputs of NAND gate 46, to the cathode of diode 48, and to the clock input of D flipflop 50. The other end of resistor 44 is connected to ground. The output of NAND gate 46 is connected to the set input of D flipflop 52. The clock input of D flipflop 52 is connected to ground, and the output of D flipflop 52 is connected to the set input of D flipflop 50 via capacitor 54. One end of resistor 56 is connected to the junction of capacitor 54 and the set input of D flipflop 50. The other end of resistor 56 is connected to ground. The D inputs of both flipflops 52 and 50 are connected to ground. Finally, the output of D flipflop 50 is connected to line 38, which supplies the count-up pulse to gate 26. Note that a line from initialization logic 32 connects to the re-set inputs of D flipflops 50 and 52.

Upon the initial application of the charge/set signal, a positive voltage will be supplied to the inputs of NAND gate 46 and to the clock input of D flipflop 50. During this initial interval, capacitor 34, which is connected to the anode of diode 48, accumulates a voltage charge. During this time the output of NAND gate 46 is low, as are the outputs of D flipflop 50 and 52. At some arbitrary time after the start of the charge/set signal, line 36 is brought to ground by the setter 16. This corresponds to point t1 of FIG. 3. As line 36 falls, NAND gate 46 chang es to a high state, and presents a logic 1 to the set input of D flipflop 52. This causes the output of D flipflop 52 to go high. This high transition is differentiated by the combination of capacitor 54 and resistor 56 to supply a positive-going pulse to the set input of D flipflop 50. At the same time, the clock input to D flipflop 50 is presented with a falling edge, since this input connects to the charge signature line 36 via diode 43. This negative-going edge on the clock input causes the positive-going pulse at the set input to set the output of D flipflop 50 to a logic 1. This occurrence constitutes the start of the count-up pulse which is supplied to gate 26 to initiate the accumulate signal from which the timer count is obtained.

At t2 of FIG. 3, the charge line 36 goes high again. This supplies a positive going edge to the clock input of D flipflop 50 which then causes the output of D flipflop 50 to go low. This logic zero is supplied to NAND gate 26 on line 38 which inhibits further transmission of the oscillator signal to the counter circuit 20. Thus, the count-up pulse supplied by diode 43 allows the charge line 36 to swing negative which signals initiation of rocket burn in a single wire multiplexed system.

In principle, the maximum run time possible is established by the number of cascaded counters which comprise the counter circuitry 20 and by the storage capacity of capacitor 34. Capacitor 34 should be sized to have sufficient energy to operate the rest of the fuze circuitry during the required fuze run time, plus have sufficient energy at the end of this time to fire the detonator.

According to the method of the present invention, a precision time interval is provided using all digital circuitry by, first, counting an oscillator frequency for a designated time interval to form an accumulated timer count, second, counting down from the accumulated count in the counter circuit utilizing a rate which is proportional to and derived from the oscillator frequency, then providing an output signal when the count reaches zero.

Figure 4:
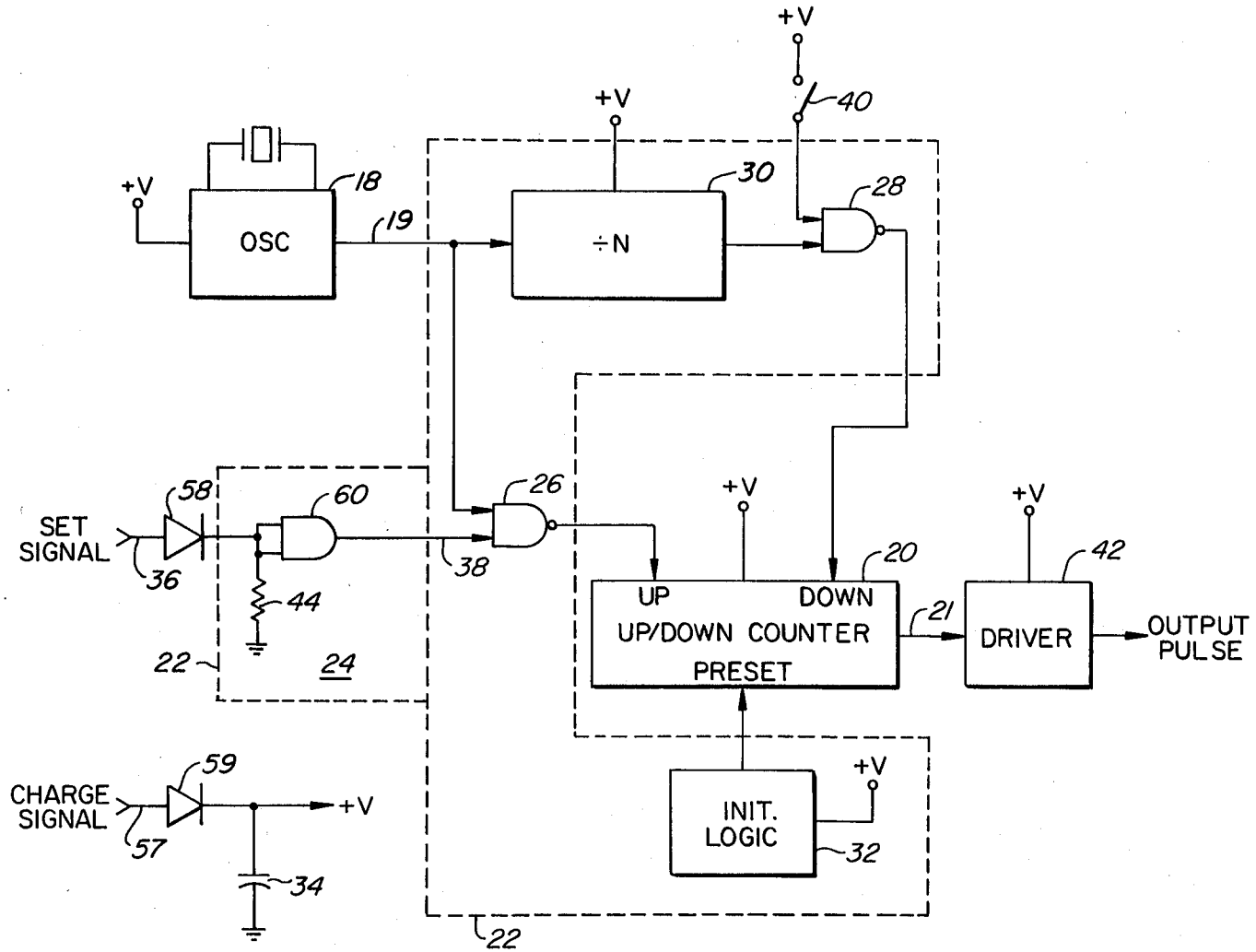
FIG. 4 is a simplified schematic of an alternative embodiment of the present invention.

FIG. 4 illustrates an alternative embodiment of the present invention which is suitable for use with analog time fuze setters. In this embodiment, the charge/set signature, as illustrated in FIG. 5, is assumed. Note the bipolar nature of this signature. Additionally, a separate line 57 is supplied by which a power-up signal is applied to the circuitry. Unlike the first embodiment described above, two lines are required, one to supply run time information and the other to supply power.

The only other difference between this alternative embodiment and the initially described embodiment lies in the decoder circuitry. In this alternative embodiment, the decoder circuitry is greatly simplified. Referring to FIG. 4, it can be seen that the run time input is applied to gate 26 via diode 58 and buffer circuit 60. Diode 58 is provided so that only the positive portion of the signal is passed to gate 26, the positive portion of the signal comprising the run time information. In other words, the positive portion of the signal is the count-up pulse. The operation of the remainder of the circuit in response to this run time information and to the closure of switch 40 remains the same. As before, the initialization logic 32 supplies a pre-set signal to counter circuit 20 in response to the initial application of voltage to the energy storage capacitor 34. In this embodiment, however, the charge signal is supplied on a separate line from the set signal. Typically, the charge signal is applied to capacitor 34 first, via power-up line 57 and diode 59. This causes initialization logic to preset counter circuitry 20. Within 5 to 8 milliseconds of the application of the charge signal to line 57, the setter then applies the set signal, FIG. 5, to line 36 to begin the accumulation of the timer count in counter circuit 20. Because of the presence of diode 58 in line 36, only the positive portion, $t_1$ through $t_2$, of the charge/set signal is passed to decoder circuit 24. The negative-going portions are ignored by the fuze circuitry. This permits the charge/set signal to be used in a multiplexing arrangement wherein, after the time interval data has been supplied, a reversal of polarity on the line can be used to fire the rocket.

In summary, the digital time fuze of the present invention overcomes several of the problems present in prior art time fuzes. Significantly, the present invention obviates the requirement for a priori knowledge of component values or the requirement of precision components before accurate time intervals can be achieved. Also, as contrasted with time fuzes of the prior art, the accuracy of the time fuze of the present invention increases as the run time interval increases. The present invention utilizes the signal of the oscillator in a manner analogous to the use of a carrier signal in communication systems. In this manner, the inaccuracies inherent witin the oscillator signal are cancelled out. The control circuitry 22 provides decoding capabilities which permit the use of a single line for receiving both charge and run time information. This greatly simplifies the setup of the ordnance system.

The terms and expressions which have been employed here are used as terms of description and not of limitations, and there is no intention, in the use of such terms and expressions of excluding equivalents of the features shown and described, or portions thereof, it being recognized that various modifications are possible within the scope of the invention

I claim:

1. A digital timing apparatus for providing an output signal at a selected and precise time interval following the occurrence of a start signal and in accordance with time interval data which is contained within a charge/-set signal, the charge/set signal including a charging portion having a charge level and a setting portion which are separated by a single transition to a predetermined threshold level, wherein the time interval data is designated by a continuous interval of the charge/set signal throughout which the predetermined threshold level is attained, the apparatus comprising oscillator means for providing a clock signal having a series of clock pulses;

control means responsive to the charge/set signal, the start signal and the clock signal, for providing an accumulate signal, the control means including means for detecting the duration of the continuous interval in the charge/set signal beginning at the single transition between the charge portion and the setting portion, and for inserting an interval of the clock signal into the accumulate signal which clock signal interval has a length determined by the duration of the continuous interval, and for providing a count-down signal which is initiated by the start signal and which has a frequency rate which is derived from the clock signal frequency; and counter means responsive to the count-down signal and to the accumulate signal for counting the number of clock pulses in the accumulate signal to form a timer count, and for counting down from the timer count in accordance with the frequency rate of the count-down signal, the counter means providing the output signal when the count reaches a predetermined count state.

2. The digital timing apparatus, as recited in claim 1, wherein the charge/set signal includes a power-up interval, the apparatus further including energy storage means for storing the energy provided in the set signal power-up interval and for providing all operating power to the apparatus.

3. The digital timing apparatus, as recited in claim 1, wherein the oscillator means is a crystal controlled oscillator.

4. The digital timing apparatus, as recited in claim 1, wherein the counter means is an up-down counter.

5. The digital timing apparatus, as recited in claim 1, further including driver means responsive to the output signal for providing a high energy output pulse.

6. The digital timing apparatus, as recited in claim 5, wherein the driver means is a regenerative switch.

7. The apparatus, as recited in claim 5, wherein the charge/set signal includes a power-up interval for supplying energy to the apparatus, and furtherwherein the apparatus includes capacitor means for storing the energy from the power-up interval, the capacitor means having the capacity to store sufficient energy to provide all operating power to the apparatus, including the energy for the high energy output pulse.

8. The apparatus, as recited in claim 2, wherein the energy storage means is a capacitor.

9. The apparatus, as recited in claim 1, wherein the start signal is provided by a switch closure.

10. The apparatus, as recited in claim 9, wherein the switch closure is provided by an inertial switch.

11. The apparatus, as recited in claim 1, wherein the control means further include initializing means, which are responsive to the charge/set signal, for resetting the control means and for presetting the counter means within a predetermined interval following the application of the charge/set signal.

12. The apparatus, as recited in claim 1, wherein the charge/set signal is applied to the apparatus on a charge line and on a set line, which is separate from the charge line, and furtherwherein the control means is responsive to the set line signal to provide the accumulate signal to the counter means, the apparatus further including energy storage means responsive to the signal on the charge line for storing the energy provided in the charge line signal and for providing all operating power to the apparatus.

13. The apparatus, as recited in claim 1, wherein the charge/set signal includes positive and negative voltage levels, and furtherwherein the control means further include rectifying means for receiving the charge/set signal, the rectifying means providing only the positive voltage level portions of the charge/set signal to the control means for further processing.

14. The apparatus, as recited in claim 13, in which the time interval data in the set line signal comprises a designated interval of positive voltage, and wherein the control means further include decoder means for deriving the length of the positive voltage interval from the set line signal, and furtherwherein the accumulate signal provided by the control means includes an interval of the clock signal which has a length substantially equal to the length of the positive voltage interval.

15. The apparatus, as recited in claim 1, wherein the oscillator means is a piezoceramic controlled oscillator.

16. A digital timing apparatus for Providing an output signal at a selected and precise time interval following the occurrence of a start signal and in accordance with time interval data which is contained within a charge/set signal, wherein the charge/set signal time interval data is designated by a portion of the charge/set signal having a predetermined voltage level which is different from the remainder of the charge/set signal and separated therefrom by single transitions to and from the predetermined voltage level the apparatus comprising oscillator means for providing a clock signal having a series of clock pulses;

control means responsive to the charge/set signal, the start signal and the clock signal, for providing an accumulate signal which includes an interval of the clock signal the length of which is determined in accordance with the charge/set signal time interval data, and for providing a count-down signal which is initiated by the start signal and which has a frequency rate which is derived from the clock signal frequency and wherein the control means comprise means responsive to the charge/set signal for generating a count-up pulse which begins at the single transition to the predetermined voltage level;

gate means responsive to a count-up pulse and the clock signal for providing the accumulate signal wherein the clock signal is included in the accumulate signal whenever the charge/set signal is at the predetermined voltage level, the count-up pulse being derived from the time interval data; and scaling counter means responsive to the clock signal and the start signal for providing the count-down signal, wherein the count-down signal is proportional to the clock signal according to a predetermined ratio; and counter means responsive to the count-down signal and to the accumulate signal, wherein the counter means counts the number of clock pulses in the accumulate signal to form a timer count, and further wherein the counter means counts down from the timer count in accordance with the frequency rate of the count-down signal, the counter means providing the output signal when the count reaches a predetermined count state.

17. The digital timing apparatus, as recited in claim 16, wherein the control means further include decoding means for deriving the time interval data from the charge/set signal.

18. The digital timing apparatus, as recited in claim 16, wherein the predetermined ratio of the scaling counter means is 1000:1.

19. The apparatus, as recited in claim 16, wherein the time interval data comprises the length of the predetermined voltage level portion of the charge/set signal, further including decoding means for detecting the length of the predetermined voltage level portion and for supplying the count-up pulse, the count-up pulse having substantially the same width as the detected length.

20. The apparatus, as recited in claim 16, wherein the length of the clock interval which is included in the accumulate signal is substantially equal to the length of the portion of the charge/set signal which has the predetermined voltage level.

21. The apparatus, as recited in claim 1 or 16, wherein the control means receive the charge/set signal on a single line.

22. A method of providing an output signal at a selected and precise time interval following the occurrence of a start signal and in accordance with time interval data provided within a charge/set signal, the charge/set signal including a charging portion, having a charge level, and a setting portion which are separated by a single transition to a predetermined threshold level, wherein the time interval data is designated by a continuous interval of the charge/set signal throughout which the predetermined threshold is attained, comprising the steps of providing a clock frequency having a series of clock pulses;

detecting the duration of the continuous interval beginning at the single transition to the predetermined threshold level;

counting the clock pulses over the duration of the continuous interval to form a timer count;

counting down from the timer count in response to the start signal at a rate which is proportional to the clock frequency; and providing the output signal when the count reaches zero.

23. A method of providing an output signal at a selected and precise time interval following the occurrence of a start signal and in accordance with time interval data provided within a charge/set signal, wherein the charge/set signal includes a charging portion which is separated from the time interval data by a single transition in level comprising the steps of providing a clock frequency having a series of clock pulses;

counting the clock pulses for an interval determined by the time interval data and beginning at the single transition to form a timer count;

counting down from the timer count in response to the start signal at a rate which is proportional to the clock frequency, including the step of dividing the clock frequency by a predetermined integer in order to derive the count down rate; and providing the output signal when the count reaches zero.

24. The method, as recited in claim 23 wherein the clock frequency dividing step the clock frequency is divided by 1000.

25. A single wire digital timing apparatus for providing an output pulse at a selected and precise time period following the occurrence of a start signal, in accordance with time interval data contained within a charge/set signal, wherein the time interval data are separated from the remainder of the charge/set signal by single transitions to a predetermined voltage level, the apparatus comprising a crystal oscillator for providing a clock signal;

detector means responsive to the single transitions in the charge/set signal for deriving the time interval data from the charge/set signal and for providing a count-up pulse having a width determined by the time interval data;

gate means responsive to the count-up pulse and to the clock signal for providing an accumulate signal which includes the clock signal whenever the count-up pulse is present;

frequency divider means responsive to the start signal and to the clock signal for providing a count-down signal which is initiated by the start signal and which has a frequency which is proportional to and derived from the clock frequency; and an up-down binary counter responsive to the accumulate signal and to the count-down signal, wherein the counter counts the number of pulses present in the accumulate signal to form a timer count and further wherein upon initiation of the count-down signal, the counter counts down from the timer count at the count-down signal rate, the counter thereafter providing the output pulse when the count reaches zero.

26. A digital timing apparatus for providing an output signal at a selected and precise time interval following the occurrence of a start signal and in accordance with time interval data which is contained within a charge/set signal, wherein the charge/set signal has a charge portion of a predetermined polarity and a time interval data portion, and further wherein the time interval data is designated by a continuous interval of the charge/set signal throughout which a predetermined threshold level is attained, the apparatus comprising oscillator means for providing a clock signal having a series of clock pulses;

control means responsive to the charge/set signal, the start signal and the clock signal, for providing an accumulate signal, the control means including means for detecting the duration of the portion of the continuous interval in the charge/set signal which has the same polarity as the charge portion and for inserting an interval of the clock signal into the accumulate signal which clock signal interval has a length determined by the duration of the continuous interval, and for providing a count-down signal which is initiated by the start signal and which has a frequency rate which is derived from the clock signal frequency; and counter means responsive to the count-down signal and to the accumulate signal for counting the number of clock pulses in the accumulate signal to form a timer count, and for counting down from the timer count in accordance with the frequency rate of the count-down signal, the counter means providing the output signal when the count reaches a predetermined count state.

* * * * *